US012485513B2

(12) United States Patent
Satomura

(10) Patent No.: US 12,485,513 B2
(45) Date of Patent: Dec. 2, 2025

(54) DEVICE FOR POLISHING OUTER PERIPHERY OF WAFER

(71) Applicant: SUMCO CORPORATION, Tokyo (JP)

(72) Inventor: Kenji Satomura, Nagasaki (JP)

(73) Assignee: SUMCO CORPORATION, Tokyo (JP)

( * ) Notice: Subject to any disclaimer, the term of this patent is extended or adjusted under 35 U.S.C. 154(b) by 337 days.

(21) Appl. No.: 18/008,902

(22) PCT Filed: May 7, 2021

(86) PCT No.: PCT/JP2021/017422
§ 371 (c)(1),
(2) Date: Dec. 7, 2022

(87) PCT Pub. No.: WO2021/251032
PCT Pub. Date: Dec. 16, 2021

(65) Prior Publication Data

US 2023/0211449 A1 Jul. 6, 2023

(30) Foreign Application Priority Data

Jun. 8, 2020 (JP) ..... 2020-099438

(51) Int. Cl.
*B24B 9/06* (2006.01)

(52) U.S. Cl.
CPC ..... *B24B 9/065* (2013.01)

(58) Field of Classification Search
CPC B24B 7/228; B24B 9/00; B24B 9/065; B24B 27/0076; B24B 37/02; B24B 37/022; B24B 37/07; B24B 37/10
(Continued)

(56) References Cited

U.S. PATENT DOCUMENTS 4,925,809 A * 5/1990 Yoshiharu ..... H01L 21/02271 438/959
5,295,331 A * 3/1994 Honda ..... H01L 21/02021 451/5

(Continued)

FOREIGN PATENT DOCUMENTS

CN 1103511 6/1995
CN 1672876 9/2005

(Continued)

OTHER PUBLICATIONS

Machine translation of KR-20130079746-A (Year: 2013).*

(Continued)

*Primary Examiner* — Robert F Neibaur
(74) *Attorney, Agent, or Firm* — Greenblum & Bernstein, P.L.C.

(57) ABSTRACT

A polishing apparatus for an outer peripheral portion of a wafer includes: a stage for horizontally holding a disc-shaped wafer; a rotation drive unit for rotating the stage around its center axis as a rotation axis; polishing heads having an inner circumferential surface mounted with polishing pads; and a polishing-head drive mechanism for bringing the polishing pads into contact with the outer peripheral portion of the wafer and sliding the polishing heads in a direction slanted relative to a center axis of the wafer or a vertical direction thereof under application of a predetermined polishing pressure to the outer peripheral portion of the wafer. The inner circumferential surface of each of the polishing heads is mounted with two or more types of the polishing pads having different physical property values in the vertical direction.

6 Claims, 4 Drawing Sheets

1

(58) Field of Classification Search
USPC ..... 451/41, 43, 44, 312, 317, 324, 325
See application file for complete search history.

(56) References Cited

U.S. PATENT DOCUMENTS

| | | | | |
|---|---|---|---|---|
| 5,866,477 | A * | 2/1999 | Ogawa | B24B 37/042 438/626 |
| 6,186,873 | B1 * | 2/2001 | Becker | B08B 1/12 15/177 |
| 6,267,648 | B1 * | 7/2001 | Katayama | H01L 21/02021 451/41 |
| 6,478,660 | B2 * | 11/2002 | Hakomori | B24B 27/0076 451/43 |
| 6,641,464 | B1 * | 11/2003 | Steere, III | B24B 21/002 451/287 |
| 6,773,335 | B2 * | 8/2004 | Hakomori | B24B 9/065 451/65 |
| 6,884,154 | B2 * | 4/2005 | Mizushima | B24D 5/14 451/60 |
| 6,935,932 | B2 * | 8/2005 | Kimura | B24B 37/345 451/36 |
| 7,066,792 | B2 * | 6/2006 | Taylor | B24B 37/26 451/63 |
| 7,534,166 | B2 * | 5/2009 | Morita | B24B 53/04 451/65 |
| 8,120,059 | B2 * | 2/2012 | Watanabe | B24B 9/065 257/618 |
| 9,991,110 | B2 * | 6/2018 | Kozasa | H01L 21/02024 |
| 2003/0054739 | A1 | 3/2003 | Mizushima et al. | |
| 2005/0142882 | A1 * | 6/2005 | Kida | H01L 21/02008 257/E21.228 |
| 2005/0250423 | A1 * | 11/2005 | Nakamura | B24B 21/06 451/41 |
| 2008/0026185 | A1 * | 1/2008 | Mizushima | H01L 21/02021 451/178 |
| 2009/0142992 | A1 * | 6/2009 | Takahashi | B24B 41/068 451/36 |
| 2011/0256815 | A1 * | 10/2011 | Mizushima | H01L 21/02024 451/177 |
| 2014/0213155 | A1 | 7/2014 | Togawa et al. | |
| 2016/0263728 | A1 * | 9/2016 | Umetsu | B28B 11/12 |
| 2018/0161953 | A1 * | 6/2018 | Chen | B24B 37/24 |
| 2020/0130124 | A1 * | 4/2020 | Tamura | H01L 21/304 |

FOREIGN PATENT DOCUMENTS

| | | | | |
|---|---|---|---|---|
| CN | 1981990 | A | 6/2007 | |
| CN | 101091238 | | 12/2007 | |
| CN | 101952943 | | 1/2011 | |
| CN | 203245737 | | 10/2013 | |
| CN | 106170847 | | 11/2016 | |
| GB | 2256822 | | 12/1992 | |
| JP | 11-28658 | | 2/1999 | |
| JP | 11-123650 | | 5/1999 | |
| JP | 2000-317789 | | 11/2000 | |
| JP | 2001-110763 | | 4/2001 | |
| JP | 2002-252191 | | 9/2002 | |
| JP | 2003-257901 | A | 9/2003 | |
| JP | 2004-349571 | | 12/2004 | |
| JP | 2005-26274 | | 1/2005 | |
| JP | 2007-50465 | | 3/2007 | |
| JP | 2009-224496 | | 10/2009 | |
| JP | 2015-153939 | | 8/2015 | |
| JP | 2015-207658 | A | 11/2015 | |
| JP | 6565780 | B2 | 8/2019 | |
| KR | 10-1993-0001332 | | 1/1993 | |
| KR | 20130079746 | A * | 7/2013 | B24B 9/065 |
| KR | 10-2014-0097995 | | 8/2014 | |
| TW | 200908125 | | 2/2009 | |
| WO | 01/62436 | | 8/2001 | |

OTHER PUBLICATIONS

Office Action issued in Corresponding KR Patent Application No. 10-2022-7042387, dated Apr. 16, 2024, along with an English translation thereof.

Office Action issued in Corresponding JP Patent Application No. 2020-099438, dated May 7, 2024, along with an English translation thereof.

International Preliminary Report on Patentability Issued in Corresponding International Patent Application No. PCT/JP2021/017422, dated Dec. 13, 2022, along with an English translation thereof.

Office Action issued in Corresponding CN Patent Application No. 202180038900.3, dated Sep. 20, 2024, along with an English translation thereof.

Office Action issued in Corresponding KR Patent Application No. 10-2022-7042387, dated Nov. 12, 2024, along with an English translation thereof.

International Search Report issued in International Patent Application No. PCT/JP2021/017422, dated Jul. 13, 2021, along with an English translation thereof.

Office Action issued in Taiwan Counterpart Patent Appl. No. 110106931, dated Sep. 28, 2021, along with an English translation thereof.

Notice of Allowance Issued in Corresponding CN Patent Application No. 202180038900.3, dated Mar. 26, 2025, along with an English translation thereof.

* cited by examiner

DEVICE FOR POLISHING OUTER PERIPHERY OF WAFER

TECHNICAL FIELD

The present invention relates to a polishing apparatus for an outer peripheral portion of a disc-shaped wafer, the polishing apparatus configured to polish the outer peripheral portion by bringing polishing pads into contact with the outer peripheral portion of the wafer rotating.

BACKGROUND ART

A disc-shaped wafer, such as a semiconductor wafer, is typically mirror-polished on its outer peripheral portion as well as its top surface and bottom surface. As shown in FIG. 4, the outer peripheral portion of the wafer is shaped in a trapezoid or an arc at an outer edge of a disc-shaped wafer 31. An outer peripheral portion 41 of the wafer 31 is also referred to as a chamfered portion or an edge portion.

In FIG. 4, the outer peripheral portion 41 of the wafer 31, which is shaped in a trapezoid, is defined by an upper slant surface 51, a lower slant surface 52, and an end surface 53. The upper slant surface 51 is slanted from a top surface 31A toward a bottom surface 31B of the wafer 31 at the outer edge of the wafer 31.

The lower slant surface 52 is slanted from the bottom surface 31B toward the top surface 31A of the wafer 31 at the outer edge of the wafer 31. The end surface 53 is defined between the upper slant surface 51 and the lower slant surface 52 and in parallel with a center axis of the wafer 31. Polishing of the outer peripheral portion 41 means that the upper slant surface 51, the lower slant surface 52 and the end surface 53 are polished.

A conventional polishing apparatus for an outer peripheral portion of a wafer includes a wafer holding unit for holding the wafer, a wafer rotating unit for rotating the wafer being held, at least one polishing head having a polishing surface on which a polishing pad is mounted, and a slurry impregnating unit for impregnating the polishing pad with polishing liquid (slurry). In the polishing apparatus for the outer peripheral portion of the wafer, the polishing pad that is mounted on the polishing head and impregnated with slurry is arranged to be relatively in contact with the outer peripheral portion of the wafer (see, for example, Patent Literature 1).

Another conventional polishing apparatus for an outer peripheral portion of a wafer includes a chuck for chucking the wafer and rotating the wafer around a center axis of the wafer as a rotation axis, a pair of upper-slant-surface polishing members for polishing an upper slant surface of the wafer, a lower-slant-surface polishing member for polishing a lower slant surface of the wafer, and an end-surface polishing member for polishing an end surface of the wafer. The pair of upper-slant-surface polishing members are arranged to face each other across the chuck. The lower-slant-surface polishing member is arranged to face the chuck between the pair of upper-slant-surface polishing members. The end-surface polishing member is arranged to face the chuck between the pair of upper-slant-surface polishing members. The polishing apparatus for the outer peripheral portion of the wafer also includes a loading unit for applying polishing pressure to the polishing members respectively toward the upper slant surface, the lower slant surface and the end surface of the wafer (see, for example, Patent Literature 2).

CITATION LIST

Patent Literature(S)

Patent Literature 1: JP 2015-207658 A
Patent Literature 2: JP 2003-257901 A

SUMMARY OF THE INVENTION

Problem(s) to be Solved by the Invention

By polishing the outer peripheral portion of the wafer using the polishing pads, the outer peripheral portion of the wafer is adjusted to have predetermined surface roughness Ra. The surface roughness Ra of the outer peripheral portion of the wafer differs depending on hardness or compressibility of polishing pads to be used. For example, the outer peripheral portion of the wafer has low surface roughness Ra when polishing pads with low hardness are used or when polishing pads with high compressibility are used.

In polishing the top surface and the bottom surface of the wafer, commonly, polishing pads with high hardness (i.e., hard polishing pads) are used in a polishing apparatus for rough polishing, while polishing pads with low hardness (i.e., soft polishing pads) are used in a polishing apparatus for finish polishing.

For example, in a case where soft polishing pads are used to polish the outer peripheral portion of the wafer, the polishing pads may extend over the surfaces (the top surface and the bottom surface) of the wafer to polish not only the outer peripheral portion of the wafer, which is a target to be polished, but also the top surface and the bottom surface. This phenomenon is called over polishing. The over polishing is accompanied by edge roll off, in which a thickness of the outer peripheral portion of the wafer is decreased, and thus flatness of the top surface and the bottom surface of the wafer is deteriorated. Further, the use of the soft polishing pads results in inferior productivity due to low polishing speed but can reduce the surface roughness Ra.

In contrast, in a case where hard polishing pads are used to polish the outer peripheral portion of the wafer, excellent productivity can be achieved due to high polishing speed and occurrence of the over polishing can be reduced by the polishing pads being prevented from extending over the surfaces of the wafer. However, the use of the hard polishing pads results in higher surface roughness Ra of the surfaces of the outer peripheral portion of the wafer than that when the soft polishing pads are used.

In this regard, when a single polishing apparatus is used for rough polishing and finish polishing, the following procedures are conceivable: rough polishing is performed using hard polishing pads, then the hard polishing pads are removed from polishing heads, and soft polishing pads are mounted on the polishing heads to perform finish polishing. This, however, requires replacement work for the polishing pads, decreasing the productivity.

It is also conceivable that a polishing apparatus dedicated to rough polishing and a polishing apparatus dedicated to finish polishing are provided separately. This, however, requires a wafer transfer mechanism for transferring the wafer between these apparatuses, increasing a manufacturing cost and decreasing operation efficiency (cycle time) to decrease the productivity.

An object of the invention is to provide a solution to the various disadvantages described above, specifically, to provide a polishing apparatus for an outer peripheral portion of a wafer that is capable of solving these problems.

Means for Solving the Problem(s)

A polishing apparatus for an outer peripheral portion of a wafer according to an aspect of the invention includes: a disc-shaped stage configured to horizontally hold a disc-shaped wafer; a rotation drive unit configured to rotate the stage around a center axis of the stage as a rotation axis; at least one polishing head having an inner circumferential surface mounted with polishing pads; and a polishing-head drive mechanism configured to bring the polishing pads into contact with an outer peripheral portion of the wafer and slide the polishing head in a direction slanted with respect to a center axis of the wafer or a vertical direction of the wafer under application of a predetermined polishing pressure to the outer peripheral portion of the wafer, in which the inner circumferential surface of the polishing head is mounted with two or more types of the polishing pads that are of different physical property values in an up and down direction of the polishing head.

In the polishing apparatus according to the above aspect of the invention, in one polishing operation, the polishing-head drive mechanism slides the polishing head within the polishing pad whose physical property value is constant.

In the polishing apparatus according to the above aspect of the invention, the inner circumferential surface of the polishing head is brought close to or separated from the outer peripheral portion of the wafer and is shaped in an arc along a circumferential direction of the outer peripheral portion.

In the polishing apparatus according to the above aspect of the invention, the polishing head includes a first polishing head configured to polish a lower slant surface defining the outer peripheral portion of the wafer, a second polishing head configured to polish an upper slant surface defining the outer peripheral portion of the wafer, and a third polishing head and a fourth polishing head arranged to face each other across the wafer and configured to polish an end surface defining the outer peripheral portion of the wafer, and the polishing-head drive mechanism brings the first to fourth polishing heads into contact with the outer peripheral portion of the wafer and simultaneously slides the first polishing head in a direction along the lower slant surface, the second polishing head in a direction along the upper slant surface, and the third polishing head and the fourth polishing head in the vertical direction of the wafer under application of a predetermined polishing pressure to the outer peripheral portion of the wafer.

In the polishing apparatus according to the above aspect of the invention, the polishing pads include a polishing pad mounted on an upper portion of the inner circumferential surface and a polishing pad mounted on a lower portion of the inner circumferential surface, and the polishing pad mounted on the lower portion of the inner circumferential surface has higher compressibility than the polishing pad mounted on the upper portion of the inner circumferential surface.

In the polishing apparatus according to the above aspect of the invention, the polishing pads include a polishing pad mounted on an upper portion of the inner circumferential surface and a polishing pad mounted on a lower portion of the inner circumferential surface, and the polishing pad mounted on the lower portion of the inner circumferential surface has lower hardness than the polishing pad mounted on the upper portion of the inner circumferential surface.

In the polishing apparatus according to the above aspect of the invention, the polishing pad mounted on the upper portion of the inner circumferential surface has a larger vertical length or length along a slant surface defined by the inner circumferential surface of the polishing head than the polishing pad mounted on the lower portion of the inner circumferential surface.

According to the above aspect of the invention, it is possible to reduce occurrence of over polishing and improve surface roughness of an outer peripheral portion of a wafer without decreasing operation efficiency (cycle time).

BRIEF DESCRIPTION OF DRAWING(S)

DESCRIPTION OF EMBODIMENT(S)

An exemplary embodiment of the invention is described below with reference to the attached drawings.

Figure 1:
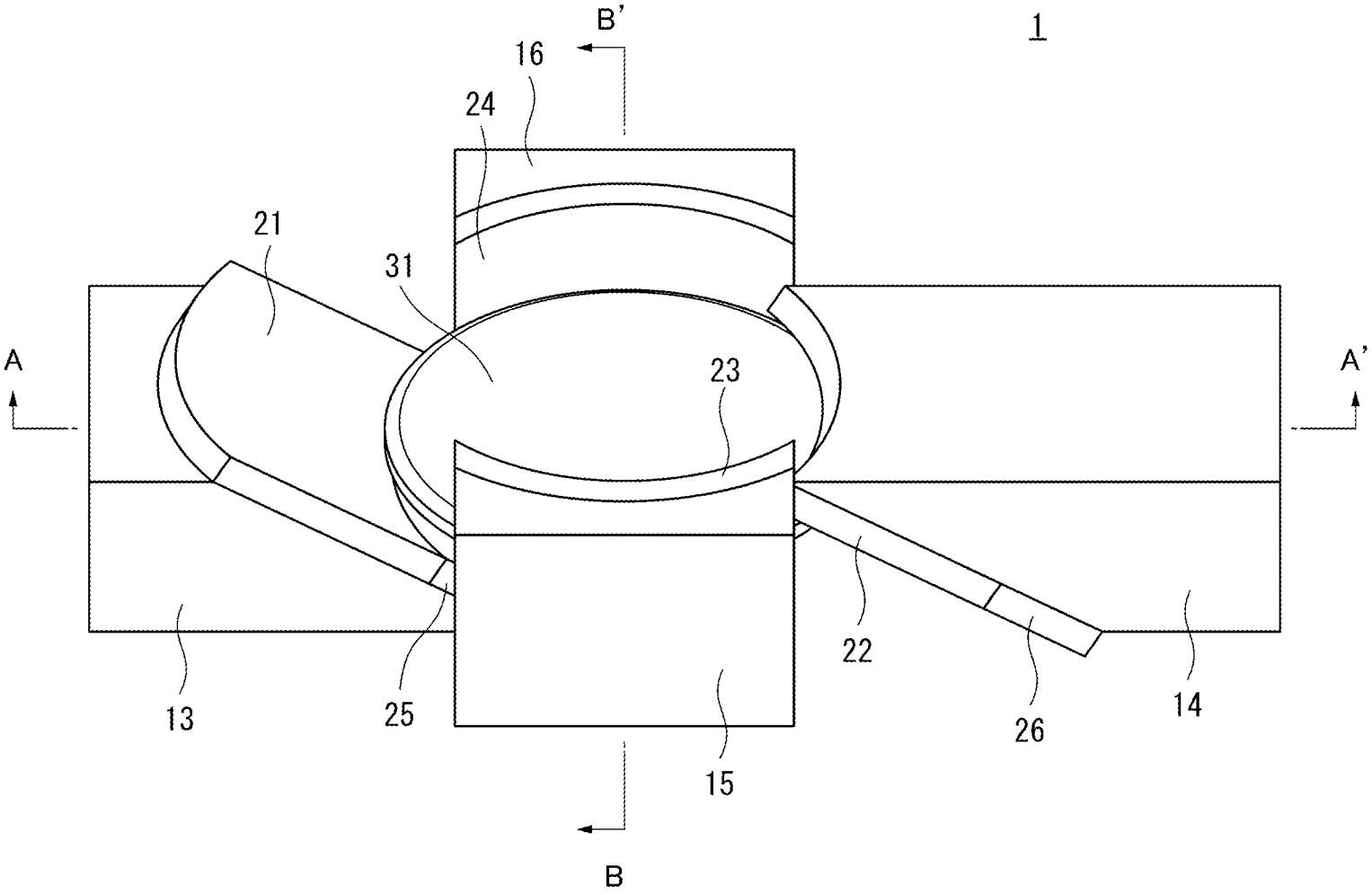
FIG. 1 is a schematic diagram showing an example of a structure of a polishing apparatus for an outer peripheral portion of a wafer according to an exemplary embodiment of the invention.
Figure 2:
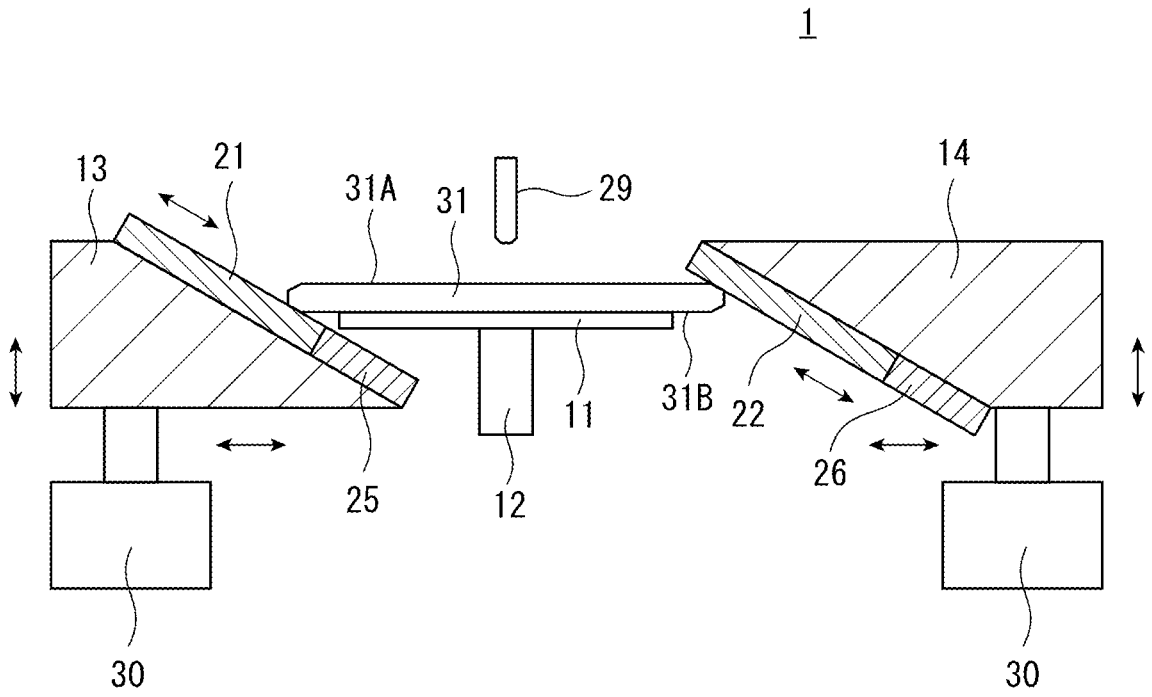
FIG. 2 is a cross-sectional view taken along A-A' of FIG. 1.
Figure 3:
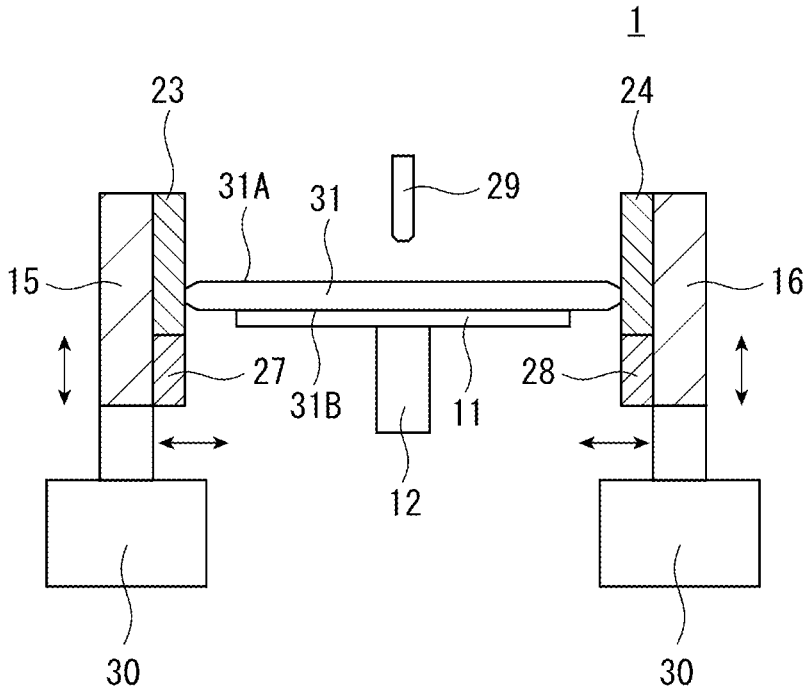
FIG. 3 is a cross-sectional view taken along B-B' of FIG. 1.

Structure of Polishing Apparatus for Outer Peripheral Portion of Wafer FIG. 1 is a schematic diagram showing an example of a structure of a polishing apparatus 1 for an outer peripheral portion of a wafer according to an exemplary embodiment of the invention. FIG. 2 is a cross-sectional view taken along A-A' of FIG. 1. FIG. 3 is a cross-sectional view taken along B-B' of FIG. 1.

The polishing apparatus 1 for the outer peripheral portion of the wafer includes: a stage 11; a rotation drive unit 12; polishing heads 13, 14, 15 and 16; first polishing pads 21, 22, 23 and 24; second polishing pads 25, 26, 27 and 28; a nozzle 29; and a polishing-head drive mechanism 30. It should be noted that FIG. 1 does not show the stage 11, the rotation drive unit 12, the second polishing pads 27 and 28, the nozzle 29 and the polishing-head drive mechanism 30.

The stage 11 shown in FIGS. 2 and 3 is substantially disc-shaped. The stage 11 horizontally holds a wafer 31 by sucking, by vacuum, the bottom surface 31B of the wafer 31 or sticking, by static electricity, to the bottom surface 31B of the wafer 31. The stage 11, whose diameter is not particularly limited, may have a diameter of about 280±10 mm for polishing the outer peripheral portion 41 of the wafer 31 with a diameter of 300 mm and a diameter of about 430±10 mm for polishing the outer peripheral portion 41 of the wafer 31 of a diameter of 450 mm. The rotation drive unit 12 is attached beneath a central portion of the stage 11 and rotates the stage 11 around its center axis as a rotation axis.

Figure 4:
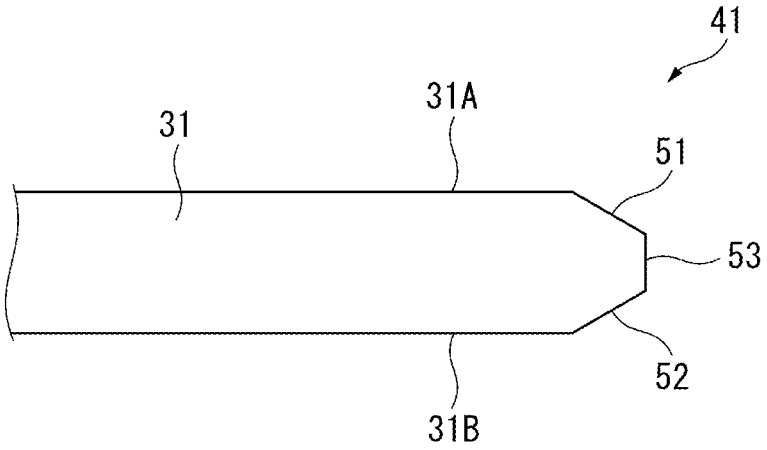
FIG. 4 RELATED ART
FIG. 4 is a partial cross-sectional view showing an example of a shape of the outer peripheral portion of the wafer.

The polishing head 13, which can be brought close to or separated from the outer peripheral portion 41 of the wafer 31, has an inner circumferential surface shaped in an arc along a circumferential direction of the outer peripheral portion 41. An upper portion of this inner circumferential surface is mounted with the first polishing pad 21 and a lower portion of the inner circumferential surface is mounted with the second polishing pad 25, thereby polishing the lower slant surface 52 (see FIG. 4) defining the outer peripheral portion 41 of the wafer 31.

The polishing head 14, which can be brought close to or separated from the outer peripheral portion 41 of the wafer 31, has an inner circumferential surface shaped in an arc along the circumferential direction of the outer peripheral portion 41. An upper portion of this inner circumferential surface is mounted with the first polishing pad 22 and a lower portion of the inner circumferential surface is mounted with the second polishing pad 26, thereby polishing the upper slant surface 51 (see FIG. 4) defining the outer peripheral portion 41 of the wafer 31.

The polishing head 15, which can be brought close to or separated from the outer peripheral portion 41 of the wafer 31, has an inner circumferential surface shaped in an arc along the circumferential direction of the outer peripheral portion 41. An upper portion of this inner circumferential surface is mounted with the first polishing pad 23 and a lower portion of the inner circumferential surface is mounted with the second polishing pad 27, thereby polishing the end surface 53 (see FIG. 4) defining the outer peripheral portion 41 of the wafer 31.

The polishing head 16, which can be brought close to or separated from the outer peripheral portion 41 of the wafer 31, has an inner circumferential surface shaped in an arc along the circumferential direction of the outer peripheral portion 41. An upper portion of this inner circumferential surface is mounted with the first polishing pad 24 and a lower portion of the inner circumferential surface is mounted with the second polishing pad 28, thereby polishing the end surface 53 (see FIG. 4) defining the outer peripheral portion 41 of the wafer 31.

The polishing heads 13, 14, 15 and 16 are arranged along the outer peripheral portion 41 of the wafer 31 to maximize a contact area with the outer peripheral portion 41.

The first polishing pads 21, 22, 23 and 24 and the second polishing pads 25, 26, 27 and 28 are collectively referred to simply as polishing pad(s).

Types of the polishing pads are, for example, a nonwoven fabric type, a foamed polyurethane type, and a suede type. The nonwoven fabric type is, for example, a polyester felt impregnated with a polyurethane resin. The suede type is made, for example, by using a base of a polyester felt impregnated with polyurethane, forming a foam layer in the polyurethane, and removing a surface portion from the foam layer to provide pores to the foam layer (the resultant layer is referred to as a nap layer). The nap layer retains polishing liquid.

Physical property values of the polishing pads are, for example, hardness, compressibility, and thickness. The compressibility refers to a percentage of shrinkage of a molded product with a predetermined shape under application of a predetermined load. Main methods of measuring the hardness of the polishing pads are shown below in (1) and (2). A main method of measuring the compressibility is shown below in (3).

(1) Hardness (JIS)

Hardness (JIS) is measured by a hardness test, Type A, in accordance with Japanese Industrial Standards (JIS K7312-1996).

(2) Hardness (ASKER)

Hardness (ASKER) is measured by an ASKER C Durometer.

(3) Compressibility (JIS)

Compressibility (JIS) is measured by using a Schopper thickness gauge (pressure surface: a circular shape with a diameter of 1 cm) in accordance with Japanese Industrial Standards (JIS L 1021). Specifically, a thickness to after pressure is applied to a specimen at an initial load for 30 seconds is measured, and then a thickness $t_1$ after the specimen is left under a final pressure for five minutes is measured. The compressibility is calculated from Expression (1) using the above thicknesses. In this measurement, the initial load is set at 100 g/cm$^2$ and the final load is set at 1120 g/cm$^2$.

$$\text{Compressibility } (\%) = (t_0 - t_1)/t_0 \times 100 \quad (1)$$

Table 1 shows specific examples of the polishing pads.

TABLE 1

| Type | Hardness | Compressibility |
|---|---|---|
| Nonwoven Fabric | 50-92 (ASKER) | 3.5-11 |
| Foamed Polyurethane | 80-88 (JIS) | 1.4-3.4 |
| Suede | 50-80 (JIS) | 8.5-40 |

In the exemplary embodiment, a single polishing apparatus is used to perform rough polishing to finish polishing of the outer peripheral portion 41 of the wafer 31. The first polishing pads 21, 22, 23 and 24 that are of the same physical property values are used. In addition, the second polishing pads 25, 26, 27 and 28 that are of the same physical property values are used.

Meanwhile, the first polishing pad 21 and the second polishing pad 25 that are of different physical property values are used. Likewise, the first polishing pad 22 and the second polishing pad 26 that are of different physical property values, the first polishing pad 23 and the second polishing pad 27 that are of different physical property values, and the first polishing pad 24 and the second polishing pad 28 that are of different physical property values are used.

It is only required that combinations of the first polishing pads 21, 22, 23 and 24 and the corresponding second polishing pads 25, 26, 27 and 28 are selected from polishing pads of physical property values shown in Table 1 in accordance with a specification required by a user regarding the surface roughness Ra of the polished outer peripheral portion 41 of the wafer 31.

In the case of selecting based on hardness, polishing pads that have higher hardness than the second polishing pads 25, 26, 27 and 28 are selected as the first polishing pads 21, 22, 23 and 24. In the case of selecting based on compressibility, polishing pads that have lower compressibility than the second polishing pads 25, 26, 27 and 28 are selected as the first polishing pads 21, 22, 23 and 24. Polishing pads of the same type but of different physical property values may be selected for the combinations of the first polishing pads 21, 22, 23 and 24 and the corresponding second polishing pads 25, 26, 27 and 28.

Hereinafter, the reason for adopting the method of mounting the polishing pads as described above is explained. Polishing pads with low hardness or high compressibility are easily deteriorated, and thus separation swarf, which is separated from polishing pad bodies, is likely to be generated in polishing the outer peripheral portion 41 of the wafer 31.

Thus, when the upper portion of the inner circumferential surface of each of the polishing heads 13, 14, 15 and 16 is mounted with a polishing pad with low hardness or high compressibility, in polishing the outer peripheral portion 41 of a wafer 31 subsequently provided, the separation swarf may partly cause deterioration in accuracy of polishing the outer peripheral portion 41 of this wafer 31.

In this regard, when the upper portion of the inner circumferential surface of each of the polishing heads 13, 14, 15 and 16 is mounted with a polishing pad with high hardness or low compressibility, in polishing the outer peripheral portion 41 of the wafer 31, polishing swarf is separated from the outer peripheral portion 41 itself of the wafer 31.

In polishing the outer peripheral portion 41 of the wafer 31, however, polishing liquid is constantly supplied from above the wafer 31 to remove most of the polishing swarf and the remaining polishing swarf is minute and of the same material as the wafer 31, and thus presumably the effect of the polishing swarf in polishing of the outer peripheral portion 41 of the wafer 31 can be ignored.

Meanwhile, since the separation swarf of the polishing pads with low hardness or high compressibility is of a different material from that of the wafer 31, it is considered that the effect of the separation swarf in polishing the outer peripheral portion 41 of the wafer 31 is greater than that of the polishing swarf.

Next, a size of each of the first polishing pads 21, 22, 23 and 24 and the second polishing pads 25, 26, 27 and 28 is described. A length of each of the first polishing pads 23 and 24 for polishing the end surface 53 is preferably in a range from 60% to 90% of a vertical length of the inner circumferential surface of corresponding one of the polishing heads 15 and 16. A length of each of the first polishing pad 21 for polishing the lower slant surface 52 and the first polishing pad 22 for polishing the upper slant surface 51 is preferably in a range from 60% to 90% of a slant surface length of the inner circumferential surface of corresponding one of the polishing heads 13 and 14.

Here, the length of each of the first polishing pads 23 and 24 and the second polishing pads 27 and 28 is defined as a vertical length. Meanwhile, the length of each of the first polishing pads 21 and 22 and the second polishing pads 25 and 26 is defined as a length along a slant surface defined by the inner circumferential surface of corresponding one of the polishing heads 13 and 14.

A lower limit of the length is determined in view of a workload of first polishing and extending a lifetime of the polishing pads with high hardness or low compressibility. An upper limit of the length is determined in view of a workload of second polishing.

A length of each of the second polishing pads 27 and 28 for polishing the end surface 53 is preferably in a range from 40% to 10% of the vertical length of the inner circumferential surface of corresponding one of the polishing heads 15 and 16. A length of each of the second polishing pad 25 for polishing the lower slant surface 52 and the second polishing pad 26 for polishing the upper slant surface 51 is preferably in a range from 40% to 10% of the slant surface length of the inner circumferential surface of corresponding one of the polishing heads 13 and 14. A lower limit of the length is determined in view of the workload of the second polishing. An upper limit of the length is determined in view of a balance between the workload of the first polishing and the workload of the second polishing.

As shown in FIGS. 2 and 3, a nozzle 29 for supplying polishing liquid (slurry) to substantially a center of the wafer 31 is provided above substantially the central portion of the stage 11. When the stage 11 mounted with the wafer 31 is rotated around its center axis as a rotation axis by the rotation drive unit 12, the polishing liquid supplied from the nozzle 29 flows by centrifugal force toward the outer peripheral portion 41 on the top surface 31A of the wafer 31, thereby being supplied to the outer peripheral portion 41 of the wafer 31, which is a target to be polished.

In using the first polishing pads 21, 22, 23 and 24, the polishing liquid to be used is preferably an alkali solution containing abrasive grains. Among the alkali solution containing abrasive grains, it is particularly preferable to use an alkali solution containing abrasive grains in which the abrasive grains are colloidal silica ($SiO_2$) with an average grain diameter of 50 nm and the alkali solution is an aqueous solution of potassium hydroxide (KOH) with pH of about from 10 to 11.

Meanwhile, in using the second polishing pads 25, 26, 27 and 28, the polishing liquid to be used is preferably an alkali solution containing no abrasive grains. It is particularly preferable that the alkali solution is an aqueous solution of potassium hydroxide (KOH) with pH of about from 10 to 11. In addition, the polishing liquid is preferably added with a polymer.

The polishing-head drive mechanism 30 shown in FIGS. 2 and 3 horizontally moves the polishing heads 13, 14, 15 and 16 in a direction toward the center axis of the stage 11 and a direction away from the center axis of the stage 11, and moves up and down the polishing heads 13, 14, 15 and 16 in a vertical direction. In polishing the upper slant surface 51 and the lower slant surface 52 defining the outer peripheral portion 41 of the wafer 31, the polishing-head drive mechanism 30 causes the horizontal movement in conjunction with the vertical movement of the polishing heads 13 and 14 such that the upper slant surface 51 and the lower slant surface 52 respectively form a predetermined angle with the top surface 31A and the bottom surface 31B of the wafer 31 (see an oblique arrow in FIG. 2).

The polishing-head drive mechanism 30 includes sliding members that are vertically and horizontally movable, ball screws configured to drive the sliding members, and another linear motion drive mechanism. The linear motion drive mechanism can be controlled for a drive amount by a step motor or the like.

The polishing-head drive mechanism 30 simultaneously causes the horizontal movement of the polishing heads 13, 14, 15 and 16 in the direction toward the center axis of the stage 11 to bring the first polishing pads 21, 22, 23 and 24 or the second polishing pads 25, 26, 27 and 28 into contact with the outer peripheral portion 41 of the wafer 31, which is held by the stage 11 rotating. The polishing-head drive mechanism 30 then simultaneously slides the first polishing pads 21, 22, 23 and 24 or the second polishing pads 25, 26, 27 and 28 in a direction slanted with respect to the center axis of the wafer 31 or the vertical direction to polish the outer peripheral portion 41 of the wafer 31 under application of a predetermined polishing pressure to the outer peripheral portion 41 of the wafer 31.

Method of Polishing Outer Peripheral Portion of Wafer

Next, an example of a method of polishing the outer peripheral portion of the wafer using the polishing apparatus 1 for the outer peripheral portion of the wafer having the above-described structure is described. First, the bottom surface 31B of the wafer 31 is horizontally held by the stage 11.

Next, while the polishing liquid is supplied to substantially the center of the wafer 31 from the nozzle 29, the rotation drive unit 12 rotates the stage 11 and the wafer 31 at a predetermined rotation speed (e.g., 10 rpm) and the polishing-head drive mechanism 30 simultaneously brings, under a predetermined machining load, all the first polishing pads 21, 22, 23 and 24 of the polishing heads 13, 14, 15 and 16 into contact with corresponding portions of the outer peripheral portion 41 of the wafer 31, thereby performing the first polishing of the outer peripheral portion 41 of the wafer 31.

In this operation, the polishing-head drive mechanism 30 slides the polishing heads 13, 14, 15 and 16 in respective length directions within the length along the slant surface defined by the inner circumferential surface of the first polishing pads 21 and 22 or the vertical length of the first polishing pads 23 and 24. That is, in the first polishing, the polishing-head drive mechanism 30 slides the polishing heads 13, 14, 15 and 16 within the first polishing pads 21, 22, 23 and 24 that are of the same physical property values. This extends the lifetime of the first polishing pads 21, 22, 23 and 24.

A machining time of the first polishing is, for example, in a range about from 40 to 50 seconds. Moreover, sliding of the polishing heads 13, 14, 15 and 16 is made, for example, for two to three reciprocations.

This allows the lower slant surface 52 of the outer peripheral portion 41 of the wafer 31 to be polished by the first polishing pad 21, the upper slant surface 51 of the outer peripheral portion 41 to be polished by the first polishing pad 22, and the end surface 53 of the outer peripheral portion 41 to be polished by the first polishing pads 23 and 24.

Next, while the polishing liquid is supplied to substantially the center of the wafer 31 from the nozzle 29, the rotation drive unit 12 rotates the stage 11 and the wafer 31 at a predetermined rotation speed (e.g., 10 rpm) and the polishing-head drive mechanism 30 simultaneously brings, under a predetermined machining load, all the second polishing pads 25, 26, 27 and 28 of the polishing heads 13, 14, 15 and 16 into contact with corresponding portions of the outer peripheral portion 41 of the wafer 31, thereby performing the second polishing of the outer peripheral portion 41 of the wafer 31.

In this operation, the polishing-head drive mechanism 30 slides the polishing heads 13, 14, 15 and 16 in respective length directions within the length along the slant surface defined by the inner circumferential surface of the second polishing pads 25 and 26 or the vertical length of the second polishing pads 27 and 28. That is, in the second polishing, the polishing-head drive mechanism 30 slides the polishing heads 13, 14, 15 and 16 within the second polishing pads 25, 26, 27 and 28 that are of the same physical property values. This extends the lifetime of the second polishing pads 25, 26, 27 and 28.

A machining time of the second polishing is, for example, in a range about from 5 to 10 seconds. Moreover, sliding of the polishing heads 13, 14, 15 and 16 is made, for example, for one to two reciprocations.

This allows the lower slant surface 52 of the outer peripheral portion 41 of the wafer 31 to be polished by the second polishing pad 25, the upper slant surface 51 of the outer peripheral portion 41 to be polished by the second polishing pad 26, and the end surface 53 of the outer peripheral portion 41 to be polished by the second polishing pads 27 and 28.

Effects of Exemplary Embodiment

As described above, the following effects can be attained in the above exemplary embodiment.

1) In the first polishing, since polishing pads with high hardness or low compressibility are used as the first polishing pads 21, 22, 23 and 24, sinking of the first polishing pads 21, 22, 23 and 24 into the wafer 31 during the first polishing is reduced. This prevents the first polishing pads 21, 22, 23 and 24 from extending over the top surface 31A or the bottom surface 31B of the wafer 31. Consequently, in the first polishing, occurrence of over polishing can be prevented and a scratch or indentation generated in the prior step is also removed. Furthermore, because of the high polishing speed, excellent productivity is attained.
2) In the second polishing, immediately after the first polishing, the outer peripheral portion 41 of the wafer 31 is polished by the second polishing pads 25, 26, 27 and 28 mounted on the lower portion of the inner circumferential surface of the polishing heads 13, 14, 15 and 16. That is, in the exemplary embodiment, it is not necessary to remove the first polishing pads 21, 22, 23 and 24 from the polishing heads 13, 14, 15 and 16 and mount the second polishing pads 25, 26, 27 and 28 on the polishing heads 13, 14, 15 and 16. Alternatively, it is also not necessary to transfer, by a wafer transfer mechanism, the wafer after the first polishing to a polishing apparatus dedicated to the second polishing. Thus, a manufacturing cost can be reduced and operation efficiency (cycle time) is improved, thereby improving productivity.
3) In the exemplary embodiment, since the machining time of the first polishing is in a range about from 40 to 50 seconds and the machining time of the second polishing is in a range about from 5 to 10 seconds, it is possible to reduce the surface roughness Ra of the outer peripheral portion 41 of the wafer 31 to 0.4 or less, reduce occurrence of over polishing to the extent possible, and also prevent a decrease in productivity.
4) In the exemplary embodiment, since the polishing liquid in the second polishing is added with a polymer, wettability of the outer peripheral portion 41 of the wafer 31 during the second polishing can be improved.

Other Exemplary Embodiment(s)

It should be noted that the specific arrangement of the invention, which is not limited by the exemplary embodiment of the invention described in detail with reference to the attached drawings, encompasses design modifications and the like as long as such modifications are compatible with an object of the invention.

In the above exemplary embodiment, a rotation direction of the wafer 31 is not particularly described. However, in both the first polishing and the second polishing, the wafer 31 may be rotated clockwise and counterclockwise.

The above exemplary embodiment shows an example in which two types of polishing pads are used. However, any other number of types of polishing pads may be used, such as three or more. By this arrangement, for example, in a case where a user demands a more severe condition than the current one regarding the surface roughness Ra of the outer peripheral portion 41 of the wafer 31, the more severe condition can be met by performing the second polishing multiple times using two or more types of second polishing pads.

The above exemplary embodiment shows an example in which the nozzle 29 for supplying the polishing liquid to the center of the wafer 31 is provided above substantially the central portion of the stage 11. However, the arrangement of the nozzle 29 is not limited thereto. For example, the nozzle 29 may be provided above each of the polishing heads 13, 14, 15 and 16, and prior to polishing the outer peripheral portion 41, only the first polishing pads 21, 22, 23 and 24 and the second polishing pads 25, 26, 27 and 28 may be supplied with the polishing liquid to be impregnated therewith.

The above exemplary embodiment shows an example in which the single polishing head 13 is provided for polishing the lower slant surface 52 of the outer peripheral portion 41, the single polishing head 14 is provided for polishing the upper slant surface 51 of the outer peripheral portion 41, and a pair of the polishing heads 15 and 16 are provided for polishing the end surface 53 of the outer peripheral portion 41. However, the arrangement of the polishing heads is not limited thereto. For example, a plurality of polishing heads 13 and 14 may be provided and a plurality of pairs of polishing heads 15 and 16 may be provided.

The above exemplary embodiment shows an example in which a polymer is added to the polishing liquid in the second polishing. However, a polymer may be also added to the polishing liquid in the second polishing.

In the above exemplary embodiment, an example in which the invention is applied to the polishing apparatus shown in FIGS. 1 to 3. However, the application of the invention is not limited thereto. The invention is also applicable, for example, to a polishing apparatus described in JP 2003-257901 A (Patent Literature 2).

In the polishing apparatus described in Patent Literature 2, a pair of upper-slant-surface polishing members are arranged to face each other at both sides in a diameter direction of a wafer held by a chuck, a center axis of each upper-slant-surface polishing member being slanted with respect to a center axis of the wafer, a working surface of the upper-slant-surface polishing member being in contact with an entire width of an upper slant surface of the wafer. The polishing apparatus polishes the upper slant surface while the working surface of the upper-slant-surface polishing member is in line contact with the upper slant surface of the wafer during polishing. A lower-slant-surface polishing member is arranged between the pair of upper-slant-surface polishing members. The lower-slant-surface polishing member polishes a lower slant surface of the wafer while a working surface of the lower-slant-surface polishing member is in line contact with the lower slant surface during polishing.

The invention claimed is:

1. A polishing apparatus for polishing an outer peripheral portion of a wafer, the polishing apparatus comprising:

a disc-shaped stage configured to horizontally hold a disc-shaped wafer;

a rotation driver configured to rotate the stage around a center axis of the stage as a rotation axis;

at least one polishing head having an inner circumferential surface, positioned to face the stage, and the inner circumferential surface being mounted with a first polishing pad and a second polishing pad; and a polishing-head drive mechanism, including at least sliding members that are vertically and horizontally moveable and a linear motion driver, configured to bring one of the first polishing pad and the second polishing pad into contact with the outer peripheral portion of the wafer and slide the at least one polishing head in a direction angled with respect to the center axis of the stage or a vertical direction orthogonal to a width of the wafer under application of a predetermined polishing pressure to the outer peripheral portion of the wafer, wherein the second polishing pad is mounted below the first polishing pad in the vertical direction, and the second polishing pad has higher compressibility than the first polishing pad.

2. The polishing apparatus according to claim 1, wherein, in a state in which one polishing operation is performed, the polishing-head drive mechanism is further configured to move the at least one polishing head within one of a region of the first polishing pad and a region of the second polishing pad.

3. The polishing apparatus according to claim 1, wherein the inner circumferential surface of the at least one polishing head is brought close to or separated from the outer peripheral portion of the wafer by the polishing-head drive mechanism and is shaped in an are along a circumferential direction of the outer peripheral portion of the wafer.

4. The polishing apparatus according to claim 1, wherein the at least one polishing head further comprises a first polishing head configured to polish a lower angled surface defining the outer peripheral portion of the wafer, a second polishing head configured to polish an upper angled surface defining the outer peripheral portion of the wafer, and a third polishing head and a fourth polishing head arranged to face each other across the wafer and configured to polish an end surface defining the outer peripheral portion of the wafer, and the polishing-head drive mechanism is further configured to bring the first, second, third, and fourth polishing heads into contact with the outer peripheral portion of the wafer and simultaneously move the first polishing head in a direction along the lower angled surface, the second polishing head in a direction along the upper angled surface, and the third polishing head and the fourth polishing head in the vertical direction of the wafer under application of a predetermined polishing pressure to the outer peripheral portion of the wafer.

5. The polishing apparatus according to claim 1, wherein the polishing-head drive mechanism is configured to reciprocate the at least one polishing head to polish the outer peripheral portion of the wafer using the first polishing pad and then polish the outer peripheral portion of the wafer using the second polishing pad.

6. The polishing apparatus according to claim 1, wherein the first polishing pad has a larger vertical length or length along an angled surface defined by the inner circumferential surface of the polishing head than the second polishing pad.

* * * * *